US005242884A

United States Patent [19]

Mando et al.

[11] Patent Number: 5,242,884

[45] Date of Patent: Sep. 7, 1993

[54] HEAT-SENSITIVE RECORDING MATERIAL

[75] Inventors: Ritsuo Mando, Sakai; Toshikazu Onishi, Amagasaki, both of Japan

[73] Assignee: Kanzaki Paper Manufacturing Co., Ltd., Tokyo, Japan

[21] Appl. No.: 9,399

[22] Filed: Jan. 27, 1993

Related U.S. Application Data

[63] Continuation of Ser. No. 851,944, Mar. 13, 1992, abandoned.

[30] Foreign Application Priority Data

Mar. 15, 1991 [JP] Japan ..... 3-51512

[51] Int. Cl.[5] ..... B41M 5/28

[52] U.S. Cl. ..... 503/209; 503/225

[58] Field of Search ..... 503/209, 225

[56] References Cited

U.S. PATENT DOCUMENTS

| | | | |
|---|---|---|---|
| 4,020,056 | 4/1977 | Farber | 260/240 D |
| 4,447,487 | 5/1984 | Maekawa et al. | 503/200 |
| 4,603,339 | 7/1986 | Iwakura et al. | 503/216 |
| 4,659,643 | 4/1987 | Ishida et al. | 503/208 |
| 4,761,396 | 8/1988 | Kanda et al. | 503/209 |

FOREIGN PATENT DOCUMENTS

| | | | |
|---|---|---|---|
| 0124377 | 11/1984 | European Pat. Off. | 503/209 |

*Primary Examiner*—Pamela R. Schwartz
*Attorney, Agent, or Firm*—Wenderoth, Lind & Ponack

[57] ABSTRACT

A heat-sensitive recording material comprising a substrate and a heat-sensitive recording layer disposed on said substrate, said heat-sensitive recording layer containing a colorless or light-colored basic dye and a color developer capable of causing color development upon contact with said basic dye by application of heat, characterized in that said heat-sensitive recording layer contains (i) an antioxidant comprising at least a member selected from the group consisting of the compounds represented by the following structural formula (I) and the compounds represented by the following structural formula (II), (ii) an aromatic secondary amine compound and (iii) at least a basic dye having an absorption in the near infrared region with respect to an image provided as said basic dye.

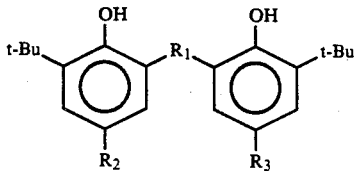

(I)

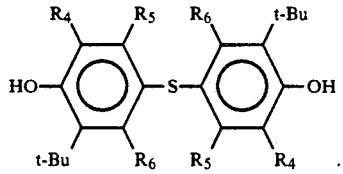

(II)

6 Claims, No Drawings

HEAT-SENSITIVE RECORDING MATERIAL

This application is a continuation of now abandoned application Ser. No. 07/851,944, filed Mar. 13, 1992.

FIELD OF THE INVENTION

The present invention relates to an improved heat-sensitive recording material which is desirably suited to be used in optical character- or mark-reading devices having a reading wavelength region in the near infrared region. More particularly, the present invention relates to an improved heat-sensitive recording material which is hardly deteriorated with irradiation of light and stably provides an excellent record image, which image is maintained in its original state without discoloration of the background even upon storage under irradiation of light over a long period of time. The improved heat-sensitive recording material exhibits outstanding recording characteristics in said optical character- or mark-reading devices.

Description of Related Art

It is known to provide a heat-sensitive recording material which is designed so as to provide a recorded image by the aid of a color reaction that takes place between a colorless or light-colored basic dye and an organic or inorganic color developer when the two substances are brought into contact with each other by heat. A heat-sensitive recording material of this type is comparatively inexpensive and suitable for use in a compact recording machine, which including those are relatively low in maintenance. This material is the type commonly used as a recording medium in facsimile systems, various computer systems or other systems.

Among the developments in office products in recent years, optical character-reading devices (OCR, including optical mark-reading devices) have become frequently used in order to obtain record images on recording mediums. Particularly, optical character-reading devices having a reading ability in the near infrared region are in greatly increasing use. For example, POS (point of sales) systems have gained increased attention as a useful tools in the market in order to rapidly meet consumer demand. In the system, a price tag having printed character or bar code is read by an OCR, and the printed information is processed by computer at the same time as the calculation of price for improving management efficiency. For reading characters, there are typically used small and inexpensive devices having a reading ability in the near infrared region.

The record images (such as black images, blue images, red images, green images, ect.) on the foregoing recording material are legible by optical character-reading devices having a reading ability in the range of visible light (400 to 700 nm), but for optical character-reading devices having a reading ability in the range of near infrared region (700 to 1100 nm), such images function as a drop-out color irrespective of the color of the image and cannot be read by the devices.

In order to eliminate the foregoing problems, there are proposed various dyes usable as a basic dye for various recording materials which are suitable for use in optical character-reading devices in which near infrared light is utilized. Specifically, Japanese patent publication No.5940/1983 proposes phthalide derivatives having two vinyl linkages and Japanese Laid-open patent No.199757/1984 proposes phthalide derivatives having a fluorene skeleton.

However, the labels comprising the heat-sensitive recording materials containing these compounds for use in the POS system are problematic with respect to their storage ability. Particularly, for those labels, there is a disadvantage that the contrast between the printed images and the background is liable to deteriorate with irradiation of light during storage.

Some of the commercially available heat-sensitive recording materials to be used as a label are provided with a protective layer on the heat-sensitive recording layer thereof, which serves to prevent the heat-sensitive recording layer from being negatively influenced by water, plasticizers, oils, etc., and because of this, the heat-sensitive recording material has a reasonable resistance not only against water but also against chemicals.

However, in the case of the commercially available label for use in the POS system which comprises the heat-sensitive recording material having a heat-sensitive recording layer containing a dye suitable for the optical character-reading device, the dye is poor in stability against irradiation of room light and because of this, when the heat-sensitive label having images printed thereon is stored under irradiation of room light, it is liable to deteriorate such that the differences in light absorption in the near infrared region become small between the record images and the background. Consequently, the record images become such that they are difficult to be distinguishably read by optical character-reading ability in the devices having a reading wavelength of the near infrared region.

There is a proposal for incorporating a conservation stabilizer comprising an aromatic secondary amine into the heat-sensitive recording layer of such heat-sensitive recording material in order to eliminate the above problem. In this case, the heat-sensitive recording material is improved with respect to stability against irradiation of room light but is accompanied by a disadvantage that the conservation stabilizer is often oxidized with oxygen of air to stain the background.

In consequence, there is an increased demand for providing a desirable heat-sensitive recording material which is desirably usable as a label in the POS system and which is free of any of the foregoing problems found in the conventional heat-sensitive recording materials.

SUMMARY OF THE INVENTION

The principal object of the present invention is to eliminate the foregoing problems found in the conventional heat-sensitive recording materials for use in the POS system and to provide an improved heat-sensitive recording material which is free of any of those problems and which is desirably usable as a label in the POS system.

Other object of the present invention is to eliminate the problem of the heat-sensitive recording material containing an aromatic secondary amine compound as the conservation stabilizer to be used as a label in the POS system that the secondary aromatic amine is oxidized with irradiation of room light during storage of the heat-sensitive recording material in a room whereby the background is discolored in a undesirable state.

A further object of the present invention is to provide a heat-sensitive recording material having an improved heat-sensitive recording layer containing a specific antioxidant and an aromatic secondary amine compound in combination, which is free of the foregoing problems found in the conventional heat-sensitive recording material having a heat-sensitive recording layer containing the conservation stabilizer and which is effectively usable as a label in the POS system.

A further object of the present invention is to provide a heat-sensitive recording material having an improved heat-sensitive recording layer containing a specific antioxidant and a conservation stabilizer comprising an aromatic secondary amine compound in combination which stably provides a high quality record image, which is maintained in the original state without discoloration of the background even upon storage under irradiation of light over a long period of time, and which exhibits outstanding recording characteristics in the optical character- or mark-reading devices having a reading wavelength in the near infrared region.

DETAILED DESCRIPTION OF THE INVENTION

The present inventors have made extensive studies in order to attain the above objects while considering the foregoing advantage of the conventional heat-sensitive recording material having a recording layer containing the conservation stabilizer.

Particularly, the present inventors have made experimental studies in order to effectively eliminate the problem of the foregoing conventional heat-sensitive recording material (which comprises a substrate and a heat-sensitive recording layer disposed on said substrate, said heat-sensitive recording layer containing a colorless or light-colored basic dye, a color developer capable of causing color development upon contact with said basic dye by heat, and an aromatic secondary amine compound as the conservation stabilizer) which entails the problem that the aromatic secondary amine compound as the conservation stabilizer is often oxidized with oxygen of air to thereby stain the background.

As a result, the present inventors have discovered that the presence of a specific antioxidant in combination with a conservation stabilizer comprising an aromatic secondary amine compound in the heat-sensitive recording layer is effective in eliminating the above problem.

On the basis of this finding, the present inventors have made further experimental studies. As a result, it has been found that in the case where the heat-sensitive recording layer contains a selected basic dye having an absorption region in the near infrared region with respect to an image provided, a selected antioxidant, and an aromatic secondary amine compound as the conservation stabilizer, the resulting heat-sensitive recording material becomes such that it stably provides a high quality record image, which is maintained in the original state even upon storage over a long period of time under irradiation of room light without being deteriorated and without causing any stain of the background and that is desirably usable as a label in the POS system, the record image printed thereon being distinguishably legible by optical character-reading devices having a reading wavelength in the near infrared region.

The present invention has been accomplished based on the above finding.

The heat-sensitive recording material according to the present invention attains the above objects, and it comprises a substrate and a heat-sensitive recording layer disposed on said substrate, said heat-sensitive recording layer containing a colorless or light-colored basic dye and a color developer capable of causing color development upon contact with said basic dye by heat, characterized in that said heat-sensitive recording layer contains (i) a specific antioxidant, (ii) an aromatic secondary amine compound, and at least (iii) a specific basic dye having an absorption in the near infrared region with respect to an image provided as said basic dye.

The antioxidant (i) to be contained in the heat-sensitive recording layer of the heat-sensitive recording material according to the present invention comprises at least one member selected from the group consisting of phenol derivatives represented by the following structural formula (I) and other phenol derivatives represented by the following structural formula (II).

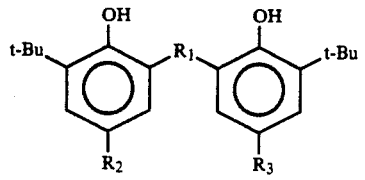

(I)

wherein, $R_1$ is a substituted or unsubstituted, saturated or unsaturated alkylene group, or a substituted or unsabstituted cycloalkylene group; $R_2$ and $R_3$ may be identical or different and are each hydrogen atom, halogen atom, a substituted or unsubstituted, saturated or unsaturated alkyl group, or a substituted or unsubstituted, saturated or unsaturated alkoxy group.

The substituted or unsubstituted, saturated or unsaturated alkylene group of $R_1$ is mean substituted or unsubstituted, saturated or unsaturated alkylidene group. The substituted or unsubstituted cycloalkylene group of $R_1$ is meant to include a substituted or unsubstituted cycloalkylidene group.

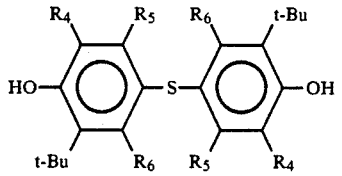

(II)

wherein, $R_4$, $R_5$ and $R_6$ are each hydrogen atom, halogen atom, a substituted or unsubstituted, saturated or unsaturated alkyl group, or a substituted or unsubstituted, saturated or unsaturated alkoxy group.

In any case, each of the unsaturated alkylene, unsaturated alkyl and unsaturated alkoxy groups includes the case of having at least a double bond between the adjacent carbon atoms of a substituent.

As for the phenol derivatives represented by the structural formula (I), $R_1$ is desired to be a saturated alkylene group, and each of $R_2$ and $R_3$ is desired to be hydrogen atom, halogen atom, a saturated alkyl group or a saturated alkoxy group are desirable. Specifically, those phenol derivatives in which $R_1$ is methylene or a saturated alkylidene group of 2 to 4 carbon atoms, and $R_2$ and $R_3$ are each a saturated alkyl group of 1 to 5 carbon atoms or a saturated alkoxy group of 1 to 4 carbon atoms are the most desirable.

As for the phenol derivatives represented by the structural formula (II), those phenol derivatives in which one or more of $R_4$, $R_5$ and $R_6$ is hydrogen atom, halogen atom, a saturated alkyl group or a saturated alkoxy group are desirable. Specifically, those phenol derivatives in which $R_4$, $R_5$ and $R_6$ are each hydrogen atom, a saturated alkyl group of 1 to 4 carbon atoms, halogen atom or a saturated alkoxy group of 1 to 4 carbon atoms are the most desirable.

The antioxidant (i) to be contained in the heat-sensitive recording layer of the heat-sensitive recording material according to the present invention may comprise two or more members selected from the group consisting of the phenol derivatives represented by the structural formula (I) and the phenol derivatives represented by the structural formula (II).

As for the amount of the antioxidant (i) to be contained in the heat-sensitive recording layer of the heat-sensitive recording material according to the present invention, there is not a particular limitation. However, in general, it is desired to be preferably in the range of 1 to 1000 parts by weight or more preferably, in the range of 3 to 200 parts by weight respectively versus 100 parts by weight of the aromatic secondary amine compound (ii) as the conservation stabilizer.

Specific examples of the phenol derivative represented by the structural formula (I) are 2,2'-methylenebis(4-methyl-6-tert-butylphenol), 2,2'-methylenebis(4-ethyl-6-tert-butylphenol), 2,2'-methylenebis(4,6-di-tertbutylphenol), 2,2'-ethylidenebis(4,6-di-tert-butylphenol), 2,2'-ethylidenebis(4-methyl-6-tert-butylphenol), 2,2'-ethylidenebis(4-ethyl-6-tert-butylphenol), 2,2'-(2,2-propylidene)bis(4,6-di-tert-butylphenol), 2,2'-L-methylenebis(4-methoxy-6-tert-butylphenol), 2,2'-methylenebis(6-tert-butylphenol), etc.

Specific examples of the phenol derivative represented tert-butylphenol), 4,4'-thiobis(2-methyl-6-tert-butylphenol), 4,4'-thiobis(5-methyl-6-tertbutylphenol), 4,4'-thiobis(2-chloro-6-tert-butylphenol), 4,4'-thiobis(2-methoxy-6-tert-butylphenol), 4,4'-thiobis(2-ethyl-6-tert-butylphenol), etc. These phenol derivatives may be used either singly or in combination of two or more of them.

Among these phenol derivatives, 2,2'-methylenebis(4-methyl-6-tert-butylphenol), 2,2'-methylenebis(4-ethyl-6-tert-butylphenol), 2,2'-ethylidenebis(4,6-di-tertbutylphenol), and 4,4'-thiobis(2-methyl-6-tert-butylphenol) are particularly desirable.

As the aromatic secondary amine compound (ii) as the conservation stabilizer to be contained in the heat-sensitive recording layer of the heat-sensitive recording material according to the present invention, there can be used various known aromatic secondary amine compounds capable of serving as an conservation stabilizer in the heat-sensitive recording layer of the heat-sensitive recording material according to the present invention.

Specific examples of such aromatic secondary amine compound are phenyl-1-naphthylamine, 4,4'-dioctyldiphenylamine, 4,4'-bis(α, α-dimethylbenzyl)diphenylamine, p-(ptoluenesulfonylamide)diphenylamine, N,N'-di-2-naphthyl-pphenylenediamine, N,N'-diphenyl-p-pheylenediamine, N-phenyl-N'-isopropyl-p-phenylenediamine, N-phenyl-N'-(1,3-dimethylbutyl)-p-phenylenediamine, N-phenyl-N'-(3-methaacryloyloxy-2-hydroxypropyl)-p-phenylenediamine, etc. These aromatic secondary amine compounds (ii) may be used either singly or in combination of two or more of them.

Among these aromatic secondary amine compounds, N,N'-di-2-naphthyl-p-phenylenediamine is the most desirable since it has an appropriate melting point.

As for the amount of the aromatic secondary amine compound (ii) to be contained in the heat-sensitive recording layer of the heat-sensitive recording material according to the present invention, there is not a particular limitation. However, in general, it is desired to be preferably in the range of 10 to 500 parts by weight or more preferably, in the range of 30 to 300 parts by weight respectively versus 100 parts by weight of the basic dye (iii) having an absorption peak in the near infrared region with respect to an image provided.

As the basic dye (iii) having an absorption peak in the near infrared region with respect to an image provided to be contained in the heat-sensitive recording layer of the heat-sensitive recording material according to the present invention, there can be used various known phthalide derivatives as long as they have an absorption in the near infrared region with respect to an image provided.

As such phthalide derivative, there can be illustrated those phthalide derivatives as will be under mentioned.

That is, basic dyes having a fluorene skeleton such as 3-dimethylamino-6-(N-ethyl-N-ethoxyethylamino)fluorene-9-spiro-3'-(6'-dimethylamino)phthalide, 3-dimethylamino-6-(N-ethyl-N-methoxyethylamino)fluorene-9-spiro-3'-(6'dimethylamino)phthalide, 3-di-n-butylamino-6-(N-methyl-N-methoxyethylamino)fluorene-9-spiro-3'-(6'-dimethylamino)phthalide, 3-pyrrolidino-6-(N-ethyl-N-ethoxyethylamino)fluorene-9-spiro-3'-(6'pyrrolidino)phthalide, 3-(N-methyl-N-cyclohexylamino)-6-(N-ethyl-N-ethoxyethylamino)-fluorene-9-spiro-3'-(6'-dimethylamino)phthalide, 3-diethylamino-6-(N-methyl-N-allylamino)fluorene-9-spiro-3'-(6'-dimethylamino)phthalide, 3-dimethylamino-6-(diallylamino)fluorene-9-spiro-3'-(6'-dimethylamino)phthalide, 3-di-n-butylamino-6-(N-methyl-N-allylamino)fluorene-9-spiro-3'-(6'-dimethylamino)phthalide, 3'-(6'-dimethylamino)phthalide, 3-(N-methyl-N-cyclohexylamino)-6-(N-ethyl-N-propargylamino)-fluorene-9-spiro3'-(6'-dimethylamino)phthalide, 3-dimethylamino-6-(N-methyl-N-tetrahydrofurfurylamino)fluorene-9-spiro-3'-(6'dimethylamino)phthalide, 3-diethylamino-6-(N-ethyl-N-tetrahydrofurfurylamino)fluorene-9-spiro-3'-(6'dimethylamino)phthalide, 3-diethylamino-6-(N-methyl-N-tetrahydrofurfurylamino)fluorene-9-spiro-3'-(6'dimethylamino)phthalide, 3-di-n-propylamino-6-(N-methyl-N-tetrahydrofurfurylamino)fluorene-9-spiro-3'-(6'dimethylamino)phthalide, 3-morpholino-6-(N butyl-N-tetrahydrofurfurylamino)fluorene-9-spiro-3'-(6'pyrrolidino)phthalide, 3-(N-ethyl-N-cyclopentylamino)-6-(N-ethyl-N-tetrahydropyran-2-methylamino)fluorene-9-spiro-3'(6'-dimethylamino)phthalide, 3-dimethylamino-6-(N-ethyl-N-β-phenylethylamino)fluorene-9-spiro-3'-(6'dimethylamino)phthalide, 3-diethylamino-6-(N-methyl-N-α-phenylethylamino)fluorene-9-spiro-3'-(6'dimethylamino)phthalide, 3-diethylamino-6-(N-ethyl-N-p-chlorobenzylamino)fluorene- 9-spiro-3'-(6'dimethylamino)phthalide, 3-pyrrolidino-6-(N-butyl-N-β-phenylethylamino)fluorene-9-spiro-3'-(6'morpholino)phthalide, 3-(N-octyl-N-methylamino)-6-(N-methyl-N-a-phenylethylamino)fluorene-9-spiro-3'-(6'-dimethylamino)phthalide, 3-dimethylamino-6-(N-methyl-N-phenoxyethylamino)fluorene-9-spiro-3'-(6'-dimethylamino)phthalide, 3-diethylamino-6-(N-methyl-N-phenoxyethylamino)fluorene-9-spiro-3'-(6'-dimethylamino)phthalide, 3-di-n-butylamino-6-(N-ethyl-N-p-methoxyphenoxyethylamino)fluorene-9-spiro-3'-(6'-chlorophenoxypropylamino)fluorene-9-spiro-3-(6'-pyrrolidino)phthalide, 3-(N-methyl-N-cyclohexylamino)-6-(N-methyl-N-p-methylphenoxyethylamino)fluorene-9-spiro-3'-(6'-dimethylamino)phthalide, 3-diethylamino-6-dimethylaminofluorene-9-spiro-3'-(6'-dimethylamino)phthalide, 3,6-bis(diethylamino)fluorene-9-spiro-3'-(6'-dimethylamino)phthalide, 3-dibutylamino-6-dimethylaminofluorene-9-spiro-3'-(6'-dimethylamino)phthalide, 3-dibutylamino-6-diethylamino-fluorene-9-spiro-3'-(6'-dimethylamino)phthalide, 3,6-bis(dimethylamino)fluorene-9-spiro-3'-(6'-dimethylamino)phthalide, 3-diethylamino-6-dimethylamino-fluorene-9-spiro-3'-(6'-diethylamino)phthalide, 3-dibutylamino-6-dimethylaminofluorene-9-spiro-3'-(6'diethylamino)phthalide, 3,6-bis(diethylamino)fluorene-9-spiro-3'-(6'-diethylamino)phthalide, 3-dibutylamino-6-diethylaminofluorene-9-spiro-3'-(6'-diethylamino)phthalide, 3,6-bis(dimethylamino)fluorene-9-spiro-3'-(6'-dibutylamino)phthalide, 3-diethylamino-6-dimethylaminofluorene-9-spiro-3'-(6'-dibutylamino)phthalide, 3-dimethylamino-6-methylaminofluorene-9-spiro-3'-(6'-dimethylamino)phthalide, 3-dimethylamino-6-dibenzylaminofluorene-9-spiro-3'-(6'-dimethylamino)phthalide, 3-pyrrolidino-6'-dimethylamino-fluorene-9-spiro-3'-(6'dimethylamino)phthalide, 3-piperidino-6-dimethylaminofluorene-9-spiro-3'-(6-'dimethylamino)phthalide, 3-dimethylamino-6-(N-methyl-N-cyclohexylamino)fluorene-9-spiro-3'-(6'-dimethylamino)phthalide, etc.; divinyl phthalide dyes such as 3,3-bis[1,1-bis(4-dimethylaminophenyl)ethylene-2-yl]-4,5,6,7-tetrachlorophthalide, 3,3-bis[1,1-bis(4-diethylaminophenyl)ethylene-2-yl]-4,5,6,7-tetrachlorophthalide, 3,3-bis[1,1-bis(2-methyl-4-diethylaminophenyl)ethylene-2-yl]-4,5,6,7-tetrachlorophthalide, 3,3-bis[1,1-bis(2-methoxy-4-diethylaminophenyl)ethylene-2-yl]-4,5,6,7-tetrachlorophthalide, 3,3-bis[1,1-bis(4-dimethylaminophenyl-1-propene-2-yl]-4,5,6,7-tetrachlorophthalide, 3,3-bis[1,1-bis(4-dimethylaminophenyl)ethylene-2-yl]-5-pyrrolidinophthalide, 3,3-bis[1,1-bis(4-dimethylaminophenyl)ethylene-2-yl]-6-pyrrolidinophthalide, 3,3-bis[1,1-bis(4-dimethylaminophenyl)ethylene-2-yl]-5,6-dichlorophthalide, 3,3-bis[1,1-bis(4-dimethylaminophenyl)ethylene-2-phthalide, 3,3-bis[1,1-bis(4-dimethylaminophenyl)ethylene-2-yl,-5-dimethylaminophthalide, 3,3-bis[1,1-bis(4-dimethylaminophenyl)ethylene-2-yl,-6-dimethylaminophthalide, 3,3-bis[1,1-bis(4-dimethylaminophenyl)ethylene-2-yl]-5-nitrophthalide, 3,3-bis[1,1-bis(4-dimethylaminophenyl)ethylene-2-yl]-6-nitrophthalide, 3,3-bis[1,1-bis(4-diethylaminophenyl)ethylene-2-yl,-5-ethoxyphthalide, 3,3-bis[1,1-bis(4-diethylaminophenyl)ethylene-2-yl,-6-ethoxyphthalide, 3,3-bis[1,1-bis(4-dimethylaminophenyl)ethylene-2-yl,-5-methylphthalide, 3,3-bis[1,1-bis(4-dimethylaminophenyl)ethylene-2-yl,-6-methylphthalide, 3,3-bis1-,1-bis(4-N-ethyl-N-benzylaminophenyl)ethylene-2-yl]-4,5,6,7-tetrachlorophthalide, 3,3-bis[1,1-bis(4-N-methyl-N-p-tolylaminophenyl)ethylene-2-yl,-4,5,6,7-tetrachlorophthalide, 3,3-bis[1,1-bis(4-dimethylaminophenyl)ethylene-2-yl]-5,6-benzophthalide, 3,3-bis[1,1-bis(4-dimethylaminophenyl)ethylene-2-yl]-4-azaphthalide, 3,3-bis-[1,1-bis(4-dimethylaminophenyl)ethylene-2-yl]-5-azaphthalide, 3,3-bis-[1,1-bis(4-dimethylaminophenyl-)ethylene-2-yl-6-azaphthalide, 3,3-bis[1,1-bis(4-dimethylaminophenyl)ethylene-2-yl]-7-azaphthalide, 3,3-bis[1,1-bis(4-dimethylaminophenyl)ethylene-2-yl]-4,7-diazaphthalide, 3,3-bis-[1,1-bis(4-dimethylaminophenyl-)ethylene-2-yl]-5,6-benzo-4,7-diazaphthalide, 3,3-bis[1,1-bis(4-pyrrolidinophenyl)ethylene-2-yl-phthalide, 3,3-bis[1,1-bis(4-pyrrolidinophenyl)ethylene-2-yl]-4,5,6,7-tetrachlorophthalide, 3,3-bis[-1,1-bis(4-pyrrolidinophenyl)ethylene-2-yl]-5-nitrophthalide, 3,3-bis[1,1-bis(4-pyrrolidinophenyl)ethylene-2-yl]-6-nitrophthalide, 3,3-bis[1,1-bis(4-pyrrolidinophenyl-)ethylene-2-yl,-5-ethoxyphthalide, 3,3-bis-1,1-bis(4-pyrrolidinophenyl)ethylene-2-yl-6-ethoxyphthalide, 3,3-bis[1,1-bis(4-pyrrolidinophenyl)ethylene-2-yl]-5-,methylphthalide, 3,3-bis[-1,1-bis(4-pyrrolidinophenyl-)ethylene-2-yl]-6-methylphthalide, 3,3-bis[-1,1-bis(4-pyrrolidinophenyl)ethylene-2-yl]-5-pyrrolidinophthalide, 3,3-bis[1,1-bis(4-pyrrolidinophenyl)ethylene-2-yl]-6-pyrrolidinophthalide, 3,3-bis[1,1-bis(4-pyrrolidinophenyl)ethylene-2-yl]-5,6-dichlorophthalide, 3,3-bis[1,1-bis(4-piperidinophenyl)ethylene-2-ylphthalide, 3,3-bis[1,1-bis(4-piperidinophenyl)ethylene-2-yl]-5-dimethylaminophthalide, 3,3-bis[1,1-bis(4-piperidinophenyl)ethylene-2-yl-6-dimethylaminophthalide, 3,3-bis[1,1-bis(4-piperidinophenyl)ethylene-2-yl]-4,5,6,7-tetrachlorophthalide, 3,3-bis[1,1-bis(4-morpholinophenyl)ethylene-2-yl]-4,5,6,7-tetrachlorophthalide, 3,3-bis[1,1-bis(4-hexamethyleneiminophenyl)ethylene-2-yl]-4,5,6,7-tetraohlorophthalide, 3,3-bis[1,1-bis(2-methyl-4-pyrrolidinophenyl)ethylene-2-yl-4,5,6,7-tetrachlorophthalide, 3,3-bis[1,1-bis(2-methoxy-4-pyrrolidinophenyl-)ethylene-2-yl]-4,5,6,7-tetrachlorophthalide, 3,3-bis[1,1-bis(4-pyrrolidinophenyl)-1-propene-2-yl]-4,5,6,7-tetrachlorophthalide, 3,3-bis[1,1-bis(1-methyl-1,2,3,4-tetrahydroquinoline-4-yl)ethylene-2-yl]-4,5,6,7-tetrachlorophthalide, 3,3-bis[1,1-bis(durolidine-9-yl)ethylene-2-yl]-4,5,6,7-tetrachlorophthalide, 3,3-bis[1,1-bis(4-pyrrolidinophenyl)ethylene-2-yl]-5,6-dichloro-4,7-dibromophthalide, 3,3-bis[1,1-bis(4-pyrrolidinophenyl-)ethylene- 2-yl]-4,7-dichloro-5,6-dibromophthalide, 3,3-bis[1,1-bis(4-pyrrolidinophenyl)ethylene-2-yl]-5-chloro-4,6,7tribromophthalide, 3,3-bis[1,1-bis(4-pyrrolidinophenyl)ethylene-2-yl]-6-chloro-4,5,7-tribromophthalide, 3,3-bis[1,1-bis(4-ethylphenyl)-1-(4-dimethylaminophenyl)ethylene-2-yl]-4,5,6,7-tetrachlorophthalide, 3,3-bis-[1,1-bis(4-methylphenyl)-1-(4-pyrrolidinophenyl-)ethylene-2-yl]-4,5,6,7-tetrachlorophthalide, 3,3-bis[1-phenyl-1-(4-dibenzylaminophenyl)ethylene-2-yl]-4,5,6,7-tetrachlorophthalide, 3,3-bis[1,1-bis(4-ethoxyphenyl)ethylene-2-yl]-4,5,6,7-tetrabromophthalide, 3,3-bis[-1-(4-ethoxyphenyl)-1-(4-methoxyphenyl)ethylene-2-yl]-4,5,6,7-tetrachlorophthalide, 3,3-bis[1-(4-cyclohexylphenyl)-1-(4-pyrrolidinophenyl)ethylene-2-yl]-4,5,6,7-tetrachlorophthalide, 3,3-bis[1-(4-allylphenyl)-1-(4-diethylaminophenyl)ethylene-2-yl]-4,5,6,7-tetrachlorophthalide, 3,3-bis[1-(4-ethoxyphenyl)-1-(2-dimethylaminophenyl)ethylene-2-yl]-4,5,6,7-methylaminophenyl)-1-(3-chloro-4-ethoxyphenyl)ethylene-2-yl-6-chloro-4,5,7-tribromophthalide, 3,3-bis[1-(4-phenoxyethylphenyl)-1-(4-N-methyl-N-ethylaminophenyl)ethylene-2-yl,-5-nitrophthalide, 3,3-bis[1-(4-chlorophenoxyethylphenyl)-1-(4-N-methyl-N-ethylaminophenyl)ethylene-2-yl]-6-nitrophthalide, 3,3-bis[1-(4-N-p-chlorophenyl-N-ethylaminophenyl)-1-(3,4-dimethylphenyl)ethylene-2-yl-5-ethoxyphthalide, 3,3-bis[1-(4-methoxyphenyl)-1-(4-pyrrolidinophenyl)ethylene-2-yl]-phthalide, 3,3-bis[1-(3-nitrophenyl)-1-(3-propargylphenyl)ethylene-2-yl-4,5,6,7-tetrafluorophthalide, 3,3-bis[1-(4-$\beta$-dimethylaminoethylaminophenyl)-1-(3-acetylphenyl)ethylene-2-yl]phthalide, 3,3-bis[1-(4- $\gamma$-diethylaminopropylaminophenyl)-1-(3-p-ethylbenzoylphenyl)ethylene-2-yl]-4,5,6,7-tetrachlorophthalide, 3,3-bis[1-(4-p-chlorophenyl)-1-(4-phenetylphenyl)ethylene-2-yl]phthalide, 3,3-bis[1-(2,6-dimethyl-4-tert-butylphenyl)-1-(4-aminophenyl)ethylene-2-yl]-4,5,6,7-tetrabromophthalide, 3,3-bis[1-(4-butoxyphenyl)-1-(4-N-cyclohexyl-N-methylaminophenyl)ethylene-2-yl]-4,5,6,7-tetrabromophthalide, 3,3-bis[1-(2-methyl-4-methylmercaptophenyl)-1-(4-N,N-diallylaminophenyl)ethylene-2-yl]-5,6-dichloro-4,7-dibromophthalide, 3,3-bis[1-(4-3',3',5'-trimethylcyclohexylphenyl)-1-(N-p-methylphenyl-N-ethylaminophenyl)ethylene-2-yl]-4,5,6,7-tetrabromophthalide, 3,3-bis[1-(2-methyl-4-chloroethoxypropylphenyl)-1-(2,6-diethyl-4-butylphenyl)ethylene- 2-yl-5-chloro-4,6,7-tribromophthalide, 3,3-bis[1-(4-p-methylbenzoyloxyphenyl)-1-(3,5-dimethylphenyl)ethylene-2-yl-4,5,6-trichlorophthalide, 3,3-bis[1-(4-methylmercaptophenyl)-1-(N-p-toluoylphenyl-N-2-butenylaminophenyl)ethylene-2-yl]-4,5,6-tribromophthalide, 3,3-bis[1-(2-methyl-4-pyrrolidinophenyl)-1-(3-chloro-4-methylphenyl)-1-propene-2-yl]-4,5,6,7-tetrachlorophthalide, 3,3-bis[1-(4-o-methylphenylpropylphenyl)-1-(3-methyl-4-dibutylaminophenyl)-1-butene-2-yl]-4,5,6,7-tetrachlorophthalide, 3,3-bis[1-(3-allyl-4-p-ethylphenoxyethylphenyl)-1-(4-N-ethoxypropyl-N-ethylaminophenyl-)ethylene-2-yl]-5,6-dichloro-4,7-dibromophthalide, 3,3-bis[1-(2-methoxy-4-cyclohexylphenyl)-1-(2-ethyl-4-chloroethylmercaptoethylphenyl)ethylene-2-yl]phthalide, 3,3-bis-1-(4-cyclohexylethylphenyl)-1-(N-tetrahydrofurfuryl-N-β-methallylaminophenyl)ethylene-2-yl]-4,5,6,7-tetrachlorophthalide, 3,3-bis[1-(4-3',3'-dimethoxypropylphenyl)-1-(N-p-chlorophenyl-N-isopropylaminophenyl)ethylene-2-yl-5-ethylphthalide, 3,3-bis[1-(3,5-chloro-4-dimethylaminophenyl)-1-phenylethylene-2-yl-4,5,6,7-tetrabromophthalide, 3,3-bis[1-(2-propionyl-4-pyrrolidinophenyl)-1-(2-chloro-4-ethoxyphenyl-5-methylphenyl)ethylene-2-yl-5-butoxyphthalide, 3,3-bis[1-(4-isoamylphenyl)-1-phenylethylene-2-yl]-4-nitrophthalide, 3,3-bis[1-(4-α-naphthylphenyl)-1-(4-N-3'-methylcyclohexyl-N-acetylaminophenyl)ethylene-2-yl,-4-nitrophthalide, 3,3-bis[1-(4-p-dimethylaminophenyl)-1-(4-morpholinophenyl)ethylene-2-yl,-5-diallylaminophthalide, 3,3-bis[1-(4-isopropoxyphenyl)-1-(4-piperazinophenyl)ethylene-2-yl]-4,5,6,7-tetrachlorophthalide, 3,3-bis[1-(4-bromophenyl)-1-(1-methyl-1,2,3,4-tetrahydroquinoline-6-yl)ethylene-2-yl]-4,5,6,7-tetrachlorophthalide, 3,3-bis[1-(4-isopropoxyphenyl)-1-(2,2,4-trimethyl-1,2-dihydroquinoline-6-yl)ethylene-2-yl]-4,5,6,7-tetrachlorophthalide, 3,3-bis[1-(2-acetylamino-4-piperidinophenyl)-1-(2-acetoxy-4-3,'5'-dimethylphenoxyphenyl)ethylene-2-yl]phthalide, 3,3-bis[1-phenyl-1-(4-dimethylaminophenyl)ethylene-2-yl]-4,5,6,7-tetrachlorophthalide, 3,3-bis[1-phenyl-1-(4-pyrrolidinophenyl)ethylene-2-yl-4,5,6,7tetrachlorophthalide, 3,3-bis[1-(4-methoxyphenyl)-1-(4-dimethylaminophenyl)ethylene-2-yl]-4,5,6,7-tetrachlorophthalide, 3,3-bis[1-(4-ethoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl-4,5,6,7-tetrachlorophthalide, 3,3-bis[1-(4-phenoxyphenyl)-1-(4-pyrrolidinophenyl)ethylene-2-yl]-4,5,6,7-tetrachlorophthalide, 3,3-bis[1-(4-ethoxyphenyl)-1-(4-diethylaminophenyl)ethylene- 2-yl]-4,5,6,7-tetrachlorophthalide, 3,3-bis[1-(4-butoxyphenyl)-1-(4-piperizinophenyl)ethylene-2-yl-4,5,6,7-tetrachlorophthalide, 3,3-bis[1-(-2-methyl-4-methoxyphenyl)-1-(4-diethylaminophenyl)ethylene-2-yl]-4,5,6,7-tetrachlorophthalide, 3,3-bis[1-(-2-methyl-4-methoxyphenyl)-1-(4-pyrrolidinophenyl)ethylene-2-yl]-4,5,6,7-tetrachlorophthalide, 3,3-bis-1-(3-chloro-4-ethoxyphenyl)-1-(4-aminophenyl)ethylene-2-yl]-4,5,6,7tetrachlorophthalide, 3,3-bis[1-(4-methoxyphenyl)-1-(2-methyl-4-pyrrolidinophenyl)ethylene-2-yl,-4,5,6,7-tetrachlorophthalide, 3,3-bis-[1-(4-ethoxyphenyl)-1-(3-ethoxy-4-diethylaminophenyl)ethylene-2-yl]-4,5,6,7-tetrachlorophthalide, 3,3-bis[1-(3-methylphenyl)-1-(4-N-methyl-N-benzylaminophenyl)ethylene-2-yl-4,5,6,7tetrachlorophthalide, 3,3-bis1-(3,5-dichlorophenyl)-1-(4-hexamethyleneiminophenyl)ethylene-2-yl-4,5,6,7-tetrachlorophthalide, 3,3-bis[1-(4-ethoxyphenyl)-1-(4-piperizinophenyl)ethylene-2-yl]-5,6-benzophthalide, 3,3-bis[-1-(4-methylphenyl)-1-(durolidine-9-yl)ethylene-2-yl]-4,5,6,7-tetrachlorophthalide, 3,3-bis[1-(4-propoxyphenyl)-1-(3-methyl-4-pyrrolidinophenyl)ethylene-2-yl]-4,7-diazaphthalide, 3,3-bis[1-(4-n-butylphenyl)-1-(4-dimethylaminophenyl-)ethylene-2-yl]-5,6-benzo-4,7-diazaphthalide, 3,3-bis[1-(3-ethyl-4-ethoxyphenyl)-1-(4-diethylaminophenyl-)ethylene- 2-yl-4 azaphthalide, 3,3-bis]1-(4-ethoxyphenyl)-1-(4-piperizinophenyl)ethylene-2-yl]-5-dibutylaminophthalide, 3,3-bis1-(4-ethoxyphenyl)-1-(4-piperizinophenyl)ethylene-2-yl-5-diethylaminophthalide, 3,3-bis[1-(4-methoxyphenyl)-1-(4-dimethylaminophenyl)ethylene-2-yl-6-pyrrolidinophthalide, 3,3-bis[1-(4-N-methyl-N-β-dimethylaminoethylphenyl)-1-(4-fluorophenyl)ethylene-2-yl]-4-azaphthalide, 3,3-bis[1-(4-N-ethyl-N-β-chloroethylaminophenyl)-1-(4-cyclohexyloxyphenyl)ethylene-2-yl]-4-azaphthalide, 3,3-bis[1,1-bis(4-n-butylphenyl)ethylene-2-yl]-4,5,6,7-tetrachlorophthalide, etc.; and monovinyl phthalide dyes such as 3-(4-diethylamino-2-methoxyphenyl)-3-1-(4-dimethylaminophenyl)-1-(4-chlorophenyl)-1,3-butadienyl]benzophthalide, 3-(4-dimethylamino-2-methoxyphenyl)-3-1-(4-dimethylaminophenyl)-1-(4-chlorophenyl)-1,3-butadienyl]benzophthalide, 3-(4-di-n-butylamino-2-methoxyphenyl)-3--1-(4-dimethylaminophenyl)-1-(4-chlorophenyl)-1,3-butadienyl]benzophthalide, 3-(4-ethyl-4-cyclohexylamino-2-methoxyphenyl)-3-[1-(4-dimethylaminophenyl)-1-(4-chlorophenyl)-1,3butadienyl]benzophthalide, 3-(4-pyrrolidino-2-methoxyphenyl)-3-[1-(4-dimethylaminophenyl)-1-(4-chlorophenyl)-1,3-butadienyl]-benzophthalide, 3-(4-methyl-4-cyclohexylamino-2-methoxyphenyl)-3-[-1-(4-dimethylaminophenyl)- 1-(4-chlorophenyl)-1,3-butadienyl]benzophthalide, 3-4--ethyl-4-(4-methylphenyl)amino-2-methoxyphenyl-3-[1-(4-dimethylaminophenyl)-1-(4-chlorophenyl)-1,3-butadienyl]benzophthalide, 3-(4-ethyl-4-isopropylamino-2-methoxyphenyl)-3-[1-(4-dimethylaminophenyl)-1-(4-chlorophenyl)-1,3-butadienyl]-benzophthalide, 3-(4-diethylamino-2-methylphenyl)-3-[1-(4-dimethylaminophenyl)-1-(4-chlorophenyl)-1,3-butadienyl]benzophthalide, 3-(4-diethylamino-2-ethylphenyl)-3-[1-(4-dimethylaminophenyl)-1-(4-chlorophenyl)-1,3-butadienyl-benzophthalide, 3-(4-diethylamino-2-ethoxylphenyl)-3-[1-(4-dimethylaminophenyl)-1-(4-chlorophenyl)-1,3-butadienyl]benzophthalide, 3-(4-diethylaminophenyl)-3-1-(4-dimethylaminophenyl)-1-(4-chlorophenyl)-1,3-butadienyl]benzophthalide, 3-(4-diethylamino-2-methoxyphenyl)-3-1-(4-diethylaminophenyl)-1-(4-chlorophenyl)-1,3-butadienyl-benzophthalide, 3-(4-diethylamino-2-methoxyphenyl)-3-1-(4-pyrrolidinophenyl)-1-(4-chlorophenyl)-1,3-butadienyl]benzophthalide, 3-(4-diethylamino-2-methoxyphenyl)-3--1-(4-dimethylaminophenyl)-1-(4-chlorophenyl)-1,3-butadienylbenzophthalide, 3-(4-diethylamino-2-methoxyphenyl)-3--1-(4-dimethylaminophenyl)-1-(4-bromophenyl)-1,3-butadienyl]benzophthalide, 3-(4-diethylamino-2-methoxyphenyl)-3--1-(4-dimethylaminophenyl)-1-phenyl-1,3-butadienyl]-benzophthalide, 3-(4-diethylamino- 2-methoxyphenyl)-3-[1-(4-dimethylaminophenyl)-1-(4-methylphenyl)-1,3-butadienylbenzophthalide, 3-(4-diethylamino-2-methoxyphenyl)-3-[1-(4-dimethylaminophenyl)-1-(4-chlorophenyl)-1,3-butadienyl-4,,5,6,7-tetrachlorophthalide, 3-(4-diethylamino-2-methoxyphenyl)-3-[1-(4-dimethylaminophenyl)-1-(4-chlorophenyl)-1,3-butadienyl]-4,5,6,7-tetrabromophthalide, etc.

Among these phthalide derivatives as the basic dye (iii) having an absorption in the near infrared region, 3,3-bis[1-(4-methoxyphenyl)-1-(4-dimethylaminophenyl)ethylene-2-yl]-4,5,6,7-tetrachlorophthalide is the most appropriate in view of providing an excellent brightness and light resistance for the heat-sensitive recording material.

The foregoing phthalide derivatives may be used either singly or in combination of two or more of them.

The amount of the basic dye (iii) having an absorption in the near infrared region to be contained in the heat-sensitive recording layer of the heat-sensitive recording material according to the present invention should be properly determined so that the object of the present invention can be effectively attained. However, in general, it is desired to be preferably in the range of 0.01 to 2 g or more preferably in the range of 0.05 to 1 g, per 1 $m^2$ on the basis of dry weight.

The heat-sensitive recording material according to the present invention is desired to contain, in addition to the foregoing basic dye (iii), an appropriate basic dye having an absorption wavelength in the visible region other than the near infrared region with respect to a record image provided in the heat-sensitive recording layer thereof, in order that a record image to be provided on the heat-sensitive recording material can be clearly distinguished by eyes. In this case, the amount of such basic dye to be contained in the heat-sensitive recording layer should be properly determined. However, in general, it is desired to be preferably in the range of 0.01 to 2 g, or more preferably in the range of 0.05 to 1 g, per 1 $m^2$ of the heat-sensitive recording layer on the basis of dry weight.

As the basic dye to be additionally contained in the heat-sensitive recording layer, there can be selectively used known various colorless or light-colored basic dyes.

As such colorless or light-colored basic dye, there can be illustrated triarylmethane dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3bis(1,2-dimethylindol-3-yl)-5-dimethylaminophthalide, 3,3-bis(1,2-dimethylindol-3-yl)-6-dimethylaminophthalide, 3,3-bis( 9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide, etc.; diphenylmethane dyes such as 4,4'-bis-dimethylaminobenzhydrylbenzylether, N-halophenylleucoauramine, N-2,4,5-trichlorophenyl-leucoauramine, etc.; thiazine dyes such as benzoyl-leucomethyleneblue, p-nitrobenzoyl-leucomethyleneblue, etc.; spiro dyes such as 3-methyl-spiro-dinaphthopyran, 3-ethyl-spirodinaphthopyran, 3-phenyl-spiro-dinaphthopyran, 3-benzylspiro-dinaphthopyran, 3-methyl-naphtho(6'methoxybenzo)spiropyran, 3-propyl-spiro-dibenzopyran, etc.; lactam dyes such as rhodamine-B-anilinolactam, rhodamine(p-nitroanilino)lactam, rhodamine(o-chloroanilino)lactam, etc.; and fluoran dyes such as dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-diethylaminofluoran, 3-(N-ethyl-p-toluidino)- 6-methyl-7-phenylaminofluoran, 3-(N-ethyl-p-toluidino)-6-methyl-7-(p-toluidino)fluoran, 3-dimethylamino-6-methyl-7-phenylaminofluoran, 3-diethylamino-6-methyl-7-phenylaminofluoran, 3-di-n-butylamino-6-methyl-7-pheylaminofluoran, 3-di-n-pentylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-(N-cyclopentyl-N-ethylamino)-6-methyl-7-anilinofluoran, 3-pyrrolidino-6-methyl-7-phenylaminofluoran, 3-piperidino-6-methyl-7-phenylaminofluoran, 3-diethylamino-6-methyl-7xylidinofluoran, 3-diethylamino-7-(o-chlorophenyl)fluoran, 3-di-n-butylamino-7-(o-chlorophenylamino)fluoran, 3-pyrrolidino-6-methyl-7-p-butylphenylaminofluoran, 3-diethylamino-7-(o-fluorophenylamino)fluoran, 3-dibutylamino-7-(o-fluorophenylamino)fluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-ethylhexyl)amino-6-methyl-7-phenylamiofluoran, 3-(N-ethyl-N-tetrahydrofurfuryl)amino-6-methyl-7-anilinofluoran, 2,2-bis 4-|6'-(n-cyclohexyl-N-methylamino)-3'-methylspiro|phthalide-3,9'-xanthene|-2'-ylamino|phenyl propane, etc. These basic dyes may be used either singly or in combination of two or more of them.

The color developer usable in the present invention includes known substances capable of causing color development upon contact with any of the foregoing basic dyes.

Specific examples of such color developer are: 2,2-bis(4-hydroxyphenyl)-4-methylpentane, 1,3-bis[1-(4-hydroxyphenyl)-1-methylethyl,benzene]1,4-bis[1-(4-hydroxyphenyl)-1-methylethyl]benzene, 4-tert-butylphenol, 4-hydroxydiphenoxide, α-naphthol, β-naphthol, 4-hydroxyacetophenone, 4-tert-octylcatechol, 2,2'-hydroxydiphenyl, 4,4'-isopropylydenebis(2-tert-butylphenol), 4,4'-sec-butylidenediphenol, 4-phenylphenol, 4,4'-isopropylidenediphenol, 4,4'-cyclohexylidenediphenol, 2,2'-methylenebis(4-chlorophenol), hydroquinone, hydroquinonemonobenzylether, 4-hydroxybenzophenone, 2,4-dihydroxybenzophenone, 2,4,4'-trihydroxybenzophenone, 2,2',4,4'-tetrahydroxybenzophenone, bis(3-tert-butyl-4-hydroxy-6-methylphenyl)sulfide, bis(2-methyl-4-hydroxy-6-tert-butylphenyl)sulfide, 4,4'-dihydroxydiphenylsulfide, 4,4'-dihydroxydiphenylsulsulfone, 2,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-tetramethyldiphenylsulfone, bis(3-allyl-4-hydroxyphenyl)sulfone, 4-hydroxy-4'-methyldiphenylsulfone, 3,4-dihydroxydiphenylsulfone, 3,4-dihydroxy-4'-methyldiphenylsulfone, 4,4'-methylenebis(oxyethylenethio)diphenol, 1,5-di(4-hydroxyphenylthio)-3-oxapentane, bis(4-hydroxypheylthioethoxy)methane, dimethyl 4-hydroxyphthalate, methyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate; phenolic compounds such as novolak-type phenolic resin, phenol polymer, etc.; aromatic carboxylic acids such as benzoic acid, p-tert-butyl benzoic acid, trichlorobenzoic acid, terephthalic acid, 3-secbutyl-4-hydroxybenzoic acid, 3-cyclohexyl-4-hydroxybenzoic acid, 3,5-dimethyl-4-hydroxybenzoic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3, 5-di-α-methylbenzylsalicylic acid, etc.; salts of said phenolic compounds or aromatic carboxylic acids with a polyvalent metal such as zinc, magnesium, aluminum, calcium, titanium, manganese, tin, and nickel; and organic acid substances such as antipyrine complex of zinc thiocyanate.

These color developers may be used either singly or in combination of two or more of them.

A pronounced effect is provided when the color developer is 4-hydroxy-4'-isopropoxydiphenylsulfone, 1,5-di(4-hydroxyphenylthio)-3-oxapentane or bis(4-hydroxyphenylthioethoxy)methane particularly in view of conservation stability of the heat-sensitive recording material.

The amount of the color developer to be contained in the heat-sensitive recording layer of the heat-sensitive recording material according to the present invention is not specifically limited but it should be properly determined depending upon the type thereof.

However, in general, it is desired to be preferably in the range of 50 to 1000 parts by weight versus 100 parts by weight of the basic dye (either in the case of using the foregoing basic dye (iii) or in the case of using the foregoing basic dye (iii) and the additional basic dye) on the basis of dry weight.

The heat-sensitive recording layer of the heat-sensitive recording material according to the present invention is formed by applying, onto an appropriate substrate, a coating dispersion containing the foregoing basic dye (comprising the basic dye (iii) or comprising the basic dye (iii) and the additional basic dye), the foregoing color developer, the foregoing antioxidant (i) and the foregoing aromatic secondary amine compound (ii), followed by drying.

The coating dispersion is prepared by dispersing the foregoing basic dye (comprising the basic dye (iii) or comprising the basic dye (iii) and the additional basic dye), the foregoing color developer, the foregoing antioxidant (i) and the foregoing aromatic secondary amine compound (ii) into a dispersing medium such as water individually or altogether using a mixer or grinder such as ball mill, attritor, and sand mill.

The coating dispersion usually contains a binder preferably in an amount of 10 to 40% by weight or more preferably, in an amount of 15 to 30 % by weight respectively of the total amount of solids.

Specific examples of such binder include starch, hydroxyethyl cellulose, methyl cellulose, carboxymethyl cellulose, gelatin, casein, gum arabic, polyvinyl alcohol, carboxyl-modified polyvinyl alcohol, acetoacetyl-modified polyvinyl alcohol, diisobutylene-maleic anhydride copolymer salt, styrene-maleic anhydride copolymer salt, ethyleneacrylic acid copolymer salt, styrene-butadiene copolymer emulsion, urea resin, melamine resin, and amide resin.

The coating dispersion may further contain a variety of auxiliaries. Such auxiliary includes dispersing agents such as sodium dioctylsulfosuccinate, sodium dodecylbenzenesulfonate, lauryl alcohol sulfate ester sodium salt, metal salts of fatty acids, etc.; UV ray absorbers such as benzophenone; antifoaming agents; fluorescent dyes; and coloring dyes.

The coating dispersion may further contain wax such as zinc stearate, calcium stearate, polyethylene wax, carnauba wax, paraffin wax, and ester wax, or/and an inorganic pigment such as kaolin, clay, talc, calcium carbonate, calcined clay, titanium oxide, diatomaceous earth, anhydrous silica fine powder, and activated clay.

The coating dispersion may further contain an appropriate sensitizing agent. As such sensitizing agent, there can be illustrated fatty acid amides such as stearic acid amide, stearic acid methylenebisamide, oleic acid amide, palmitic acid amide, coconut oil amide, etc., and other than these, 2-(2'-hydroxy-5'-methylphenyl)benzotriazole, 2-hydroxy-4-benzyloxybenzophenone, 1,2-di(3-methylphenoxy)ethane, 1,2-diphenoxyethane, 1-phenoxy-2-(4-methylphenoxy)etane, 1-phenoxy-2-(4-methoxyphenoxy)ethane, 1-phenoxy-2-( 4-chlorophenoxy)ethane, 1-(2-methylphenoxy)-2-(4-methoxyphenoxy)ethane, naphthylbenzylether, benzyl-4-methylthiophenylether, 4-methylthiophenyl-4'-chlorobenzylether, 4-methylthiophenyl-4'-bromobenzylether, 4-methylthiophenyl-4'-methylbenzylether, 4-methylthiophenyl-2'-methylbenzylether, 4-methylthiophenyl-4'-butylbenzylether, 4-methylthiophenyl-4'-methoxybenzylether, benzyl oxalate, di-p-methylbenzyl oxalate, di-p-chlorobenzyl oxalate, dimethyl terephthalate, dibutyl terephthalate, dibenzyl terephthalate, dibutyl isophthalate, 1-hydroxynaphthoic acid phenyl ester, p-benzylbiphenyl, 1,4-diphenylthiobutane, and 1,4-divinyloxyethoxybenzene. The sensitizing agent can also include known various heat melting materials.

A pronounced effect is provided when the sensitizing agent is 1,2-di(3-methylphenoxy)ethane, 1,2-diphenoxyethane, 1-phenoxy-2-(4-methylphenoxy)ethane, 1-(2-methylphenoxy)-2-(4-methoxyphenoxy)ethane, dibenzyl oxalate, di-p-methyl-benzyl oxalate, or di-p-chlorobenzyl oxalate particularly in view of improving the sensitivity of the heat-sensitive recording layer of the heat-sensitive recording material according to the present invention. The amount of the sensitizing agent to be contained in the heat-sensitive recording layer is not specifically limited but in general, it is desired to be preferably in the range of 4 parts by weight or below versus 1 part by weight of the color developer on the basis of dry weight.

As above described, the heat-sensitive recording layer is formed by applying the foregoing coating dispersion onto a substrate in a predetermined amount by a conventional coating method, to thereby form a coat comprising the coating dispersion on said substrate, followed by drying. As the coating method, there can be illustrate an air knife coating method, a rod blade coating method, a pure blade coating method, a shortduel time coating method, a curtain coating method, a die coating method, etc.

The amount of the coating dispersion applied on the substrate in order to form the heat-sensitive recording layer of the heat-sensitive recording material according to the present invention is not specifically limited. However, in general, it is desired to be preferably in the range of 2 to 12 g/m$^2$ or more preferably, in the range of 3 to 10 g/m$^2$ on the basis of dry weight.

As the substrate on which the heat-sensitive recording layer is to be formed, there can be optionally used paper, plastic film, synthetic paper or synthetic fiber paper.

The heat-sensitive recording material according to the present invention may be provided, if necessary, with one or more additional layers which are known in the industrial field to which the present invention pertains.

For example, (A) an overcoat layer (protective layer) may be formed on the heat-sensitive recording layer for the purpose of protection; (B) a protective layer may be formed on the backside of the substrate for the purpose of improving the storage ability; (C) an intermediate layer (undercoat layer) may be interposed between the substrate and the heat-sensitive recording layer; and (D) an adhesive layer may be formed on the backside of the heat-sensitive recording material.

In the case (A), the overcoat layer is formed by providing a coating dispersion containing a water-soluble or water-dispersible polymer for the formation of the protective layer, applying said coating dispersion on the heat-sensitive recording layer in a predetermined amount by a conventional coating technique to form a liquid coat comprising the coating dispersion on the heat-sensitive recording layer and drying the liquid coat.

As such water-soluble or water-dispersible polymer, there can be optionally used those binder resins mentioned in the case of forming the heat-sensitive recording layer.

A pronounced effect is provided with respect to strength of the resulting overcoat layer when acetoacetyl-modified polyvinyl alcohol or carboxyl-modified polyvinyl alcohol is selectively used among those binder resins.

The coating dispersion for the formation of the overcoat layer may contain an appropriate pigment in order to improve the printing suitability and/or to prevent sticking between the heat-sensitive recording material and a thermal head used. Examples of such pigment are inorganic pigments such as calcium carbonate, zinc oxide, aluminum oxide, titanium dioxide, silicon dioxide, aluminum hydroxide, barium sulfate, zinc sulfate, talc, kaolin, clay, calcined kaolin, colloidal silica, etc. and organic pigments such as styrene microball, nylon powder, polyethylene powder, urea-formaldehyde resin filler, starch particle, etc. The amount of these pigments to be contained in the overcoat layer is not specifically limited, but it is desired to be in the range of 5 to 500 parts by weight versus 100 parts by weight of the foregoing water-soluble or water-dispersible polymer on the basis of dry weight.

The coating composition for the formation of the overcoat layer may further contain a variety of auxiliaries. Such auxiliary includes lubricants such as zinc stearate, calcium stearate, polyethylene wax, carnauba wax, paraffin wax, ester wax, etc.; surfactants (dispersing agent or wetting agent) such as sodium dioctylsulfosuccinate, etc; antifoaming agents; and water-soluble polybasic materials such as potash alum, calcium acetate, etc.

Further, the coating dispersion for the formation of the overcoat layer may contain a hardening agent such glyoxal, boric acid, dialdehyde starch, epoxy compounds, etc. In this case, an improvement is provided with respect to water resistance of the resulting overcoat layer.

As above described, the overcoat layer is formed by applying the above coating dispersion containing a water-soluble or water-dispersible polymer and if necessary, a pigment and/or one or more auxiliaries on the heat-sensitive recording layer in a predetermined amount by a conventional coating technique.

The amount of the coating dispersion to be applied on the heat-sensitive recording layer in order to form the overcoat layer should be determined with a due care that the recording sensitivity of the resulting heat-sensitive recording material is not hindered. Particularly, when the coating dispersion is applied on the heat-sensitive recording layer in an amount of exceeding 20 g/m$^2$ on the basis of dry weight, the recording sensitivity of the resulting heat-sensitive recording material is liable to markedly reduce. In view of this, said amount is desired to be preferably in the range of 0.1 to 20 g/m$^2$ or more preferably, in the range of 0.5 to 10 g/m$^2$ on the basis of dry weight.

In the case (B), the formation of the protective layer may be performed in the same manner as in the case (A) of forming the overcoat layer. Particularly, an appropriate coating dispersion containing such water-soluble or water-dispersible polymer as used in the case (A) and if necessary, such pigment and/or one or more auxiliaries as used in the case (A) is firstly provided, the coating dispersion is applied on the backside of the substrate of the heat-sensitive recording material in a predetermined amount by a conventional coating technique, followed by drying, to thereby form a desired protective layer on the backside of the substrate.

In the case (C), the intermediate layer is formed on the substrate prior to forming the heat-sensitive recording layer. In this case, there is firstly provided an appropriate coating dispersion for the formation of the intermediate layer which contain such water-soluble or water-dispersible polymer as used in the case (A), such pigment as used in the case (A) containing a pigment as the main constituent. Then, the coating dispersion is applied on the substrate in a predetermined amount by a conventional coating technique, followed by drying, to thereby form a desired intermediate layer on the substrate.

In the case (D), the adhesive layer may be formed by applying an appropriate coating liquid comprising a conventional adhesive by a conventional coating technique.

In any case, if necessary, calendering treatment may be performed for each constituent layer after its formation. In this case, the resulting heat-sensitive recording material becomes such that provides a high quality record image excelling in optical density.

DESCRIPTION OF THE PREFERRED EMBODIMENTS

The invention will be described in more detail with reference to the following examples, which are not intended to restrict the scope of the invention. In the following examples, "parts" and "%" mean "parts by weight" and "wt %", respectively, unless otherwise defined.

Example 1

(1) Preparation of dispersion A

A mixture composed of the following components was ground using a sand mill until the average particle reached 1.5 μm, to thereby obtain a dispersion A.

3,3-bis[1-(4-methoxyphenyl)-1-(4-dimethylaminophenyl)ethylene-2-yl]-4,5,6,7-tetrachlorophthalide—3 parts N,N'-di-2-naphthyl-p-phenylenediamine—3 parts methylcellulose (5% aqueous solution)—5 parts water—40 parts (2) Preparation of dispersion B A mixture composed of the following components was ground using a sand mill until the average particle size reached 1.5 μm, to thereby obtain a dispersion B.

4-hydroxy-4'-isopropoxydiphenylsulfone—30 parts methyl cellulose (5% aqueous solution)—5 parts water—55 parts (3) Preparation of dispersion C A mixture composed of the following components was ground using a sand mill until the average particle size reached 1.5 μm, to thereby obtain a dispersion C.

3-di-n-butylamino-6-methyl-7-phenylaminofluoran—10 parts 1,2-di(3-methylphenoxy)ethane—25 parts methyl cellulose (5% aqueous solution)—5 parts water—55 parts (4) Preparation of dispersion D A mixture composed of the following components was ground using a sand mill until the average particle size reached 1.5 μm, to thereby obtain a dispersion D.

2,2'-methylenebis(4-methyl-6-tert-butylphenol)—10 Parts methyl cellulose (5% aqueous solution)—5 parts water—40 parts (5) Preparation of coating dispersion E A mixture composed of the following components was well mixed while stirring, to thereby obtain a coating dispersion E for the formation of a protective layer.

10% aqueous solution of actoacetyl-modified polyvinyl alcohol (trademark name : GOHSEFIMER-Z-200, produced by Nippon Synthetic Chemical Industry Co., Ltd.)—200 parts kaolin (trademark name:UW-90, produced by EMC Company)—60 parts water—140 parts (6) Preparation of coating dispersion F A mixture composed of the following components was well mixed while stirring, to thereby obtain a coating dispersion F for the formation of an undercoat layer.

calcined clay (trademark name:ANSILEX, oil absorption:110 cc/100 g, produced by EMC Company) —100 parts polyvinyl alcohol (10% aqueous solution)—100 parts water—200 parts Formation of heat-sensitive recording layer A coating dispersion was prepared by mixing 50 parts of the dispersion A, 90 parts of the dispersion B, 60 parts of the dispersion C, 5 parts of the dispersion D, 15 parts of calcium carbonate, and 160 parts of 10% aqueous solution of polyvinyl alcohol while stirring. The coating dispersion thus obtained was applied on a paper sheet of 60 g/m$^2$ in such an amount that the coating weight after drying was 6 g/m$^2$, and dried.

Formation of protective layer (overcoat layer)

The coating dispersion E was applied on the heat-sensitive recording layer formed on the paper sheet in the above in such an amount that the coating weight after drying was 6 g/m$^2$, and dried. The resultant was subjected to supercalendering, to thereby form a protective layer (overcoat layer) on the heat-sensitive recording layer. Thus, there was obtained a heat-sensitive recording material having the heat-sensitive recording layer and the protective layer (overcoat layer) being laminated in this order on the paper sheet.

Example 2

The procedures of Example 1 were repeated, except that the 2,2'-methylenebis(4-methyl-6-tert-butylphenol) used in the preparation of the dispersion D was displaced by 2,2'-methylenebis(4-ethyl-6-tert-butylphenol), to thereby obtain a heat-sensitive recording material.

Example 3

The procedures of Example 1 were repeated, except that the 2,2'-methylenebis(4-methyl-6-tert-butylphenol) used in the preparation of the dispersion D was displaced by 2,2'-ethylidenebis(4,6-di-tert-butylphenol), to thereby obtain a heat-sensitive recording material.

Example 4

The procedures of Example 1 were repeated, except that the 2,2'-methylenebis(4-methyl-6-tert-butylphenol) used in the preparation of the dispersion D was displaced by 4,4'-thiobis(2-methyl-6-tert-butylphenol), to thereby obtain a heat-sensitive recording material.

Example 5

The procedures of Example 1 were repeated, except that the 2'-methylenebis(4-methyl-6-tert-butylphenol) used in the preparation of the dispersion D was displaced by 4,4'thiobis(3-methyl-6-tert-butylphenol), to thereby obtain a heat-sensitive recording material.

Example 6

The procedures of Example 1 were repeated, except that the 3,3-bis[1-(4-methoxyphenyl)-1-(4-dimethylaminophenyl)ethylene-2-yl]-4,5,6,7-tetrachlorophthalide used in the preparation of the dispersion A was replaced by 3,3-bis-1-(4-methoxyphenyl)-1-(4-pyrrolidinophenyl)ethylene-2-yl]-4,5,6,7-tetrachlorophthalide, to thereby obtain a heat-sensitive recording material.

Example 7

The procedures of Example 1 were repeated, except that the 3,3-bis[1-(4-methoxyphenyl)-1-(4-dimethylaminophenyl)ethylene-2-yl-4,5,6,7-tetrachlorophthalide used in the preparation of the dispersion A was replaced by 3,3-bis[1,1-bis(4-pyrrolidinophenyl)ethylene-2-yl]-4,5,6,7-tetrabromophthalide, to thereby obtain a heat-sensitive recording material.

Example 8

The procedures of Example 1 were repeated, except that 3 parts of 3-(4-diethylamino-2-methoxyphenyl)-3-[1-(4-dimethylaminophenyl)-1-(4-chlorophenyl)-1,3-butadienyl]benzophthalide was additionally used in the preparation of the dispersion A, to thereby obtain a heat-sensitive recording material.

Example 9

The procedures of Example 1 were repeated, except that 60 parts of bis(4-hydroxyphenylthioethoxy)methane was used instead of the 30 parts of 4-hydroxy-4'-isopropoxydiphenylsulfone in the preparation of the dispersion B, and the 1,2-di(3-methylphenoxy)ethane was not used in the preparation of the dispersion C, to thereby obtain a heat-sensitive recording material.

Example 10

The procedures of Example 1 were repeated, except that the 4-hydroxy-4'-isopropoxydiphenylsulfone used in the preparation of the dispersion B was replaced by 4,4'-isopropylidenediphenol, to thereby obtain a heat-sensitive recording material.

Example 11

The procedures of Example 1 were repeated, except that 1 part of 2,2'-methylenebis(4-methyl-6-tert-butylphenol) was additionally used in the preparation of the dispersion A, and the dispersion D was not used, to thereby obtain a heat-sensitive recording material.

Example 12

The procedures of Example 1 were repeated, except that the 3-di-n-butyl-6-methyl-7-phenylaminofluoran used in the preparation of the dispersion C was replaced by 3-N-ethyl-N-iso-pentylamino-6-methyl-7-phenylaminofluoran, to thereby obtain a heat-sensitive recording material.

Example 13

The procedures of Example 1 were repeated, except that the N,N'-di-2-naphthyl-p-phenylenediamine used in the preparation of the dispersion A was replaced by 4,4'-bis(α,α -dimethylbenzyl)diphenylamine, to thereby obtain a heat-sensitive recording material.

Example 14

The coating dispersion F prepared in Example 1 was applied on a paper sheet of 60 g/m$^2$ in such an amount that the coating weight after drying was 7 g/m$^2$, and dried.

The resultant was subjected to supercalendering, to thereby form a desired intermediate layer (undercoat layer) on the paper sheet. Then, the procedures of Example 1 of forming the heat-sensitive recording layer and the protective layer to thereby obtain a heat-sensitive recording material having the intermediate layer, the heat-sensitive recording layer and the protective layer being laminated in this order on the sheet.

Example 15

The procedures of Example 1 were repeated, except that in the preparation of the coating dispersion E, there were used carboxyl-modified polyvinyl alcohol (trademark name : KL-318, produced by Kuraray Co., Ltd.) instead of the acetoacetyl-modified polyvinyl alcohol and calcium carbonate instead of the kaolin, to thereby obtain a heat-sensitive recording material.

Example 16

The procedures of Example 1 were repeated, except that the step of forming the protective layer using the coating dispersion E was not performed, to thereby obtain a heat-sensitive recording material.

Comparative Example 1

The procedures of Example 1 were repeated, except that there was not used the N,N'-di-2-naphthyl-p-phenylene diamine in the preparation of the dispersion A, to thereby obtain a comparative heat-sensitive recording material.

Comparative Example 2

The procedures of Example 1 were repeated, except that the 2,2'-methylenebis(4-methyl-6-tert-butylphenol) used in the preparation of the dispersion D was replaced by 4,4'-butylidenebis(6-tert-butyl-m-cresol), to thereby obtain a comparative heat-sensitive recording material.

Comparative Example 3

The procedures of Example 1 were repeated, except that the 2,2'-methylenebis(4-methyl-6-tert-butylphenol) used in the preparation of the dispersion D was replaced by 1-[α-methy-α-(4'-hydroxyphenyl)ethyl]-4-[α, α-bis(-4''-hydroxyphenyl)ethyl]benzene, to thereby obtain a comparative heat-sensitive recording material.

Comparative Example 4

The procedures of Example 1 were repeated, except that the 2,2'-methylenebis(4-methyl-6-tert-butylphenol) used in the preparation of the dispersion D was replaced by 1,1,3-tris(2-methyl-4-hydroxy-5-cyclohexylphenyl)-butane, to thereby obtain a comparative heat-sensitive recording material.

Comparative Example 5

The procedures of Example 1 were repeated, except that the 2,2'-methylenebis(4-methyl-6-tert-butylphenol) used in the preparation of the dispersion D was replaced by 1,1,3-tris(2-methyl-4-hydroxy-5-tert-butylphenyl)butane, to thereby obtain a comparative heat-sensitive recording material.

Comparative Example 6

The procedures of Example 1 were repeated, except that the 2,2'-methylenebis(4-methyl-6-tert-butylphenol) used in the preparation of the dispersion D was replaced by 4,4'-thiobis(3-methylphenol), to thereby obtain a comparative heat-sensitive recording material.

Comparative Example 7

The procedures of Example 1 were repeated, except that the 2,2'-methylenebis(4-methyl-6-tert-butylphenol) used in the preparation of the dispersion D was replaced by 2-(2'-hydroxy-5'-methylphenyl)benzotriazole, to thereby obtain a comparative heat-sensitive recording material.

Comparative Example 8

The procedures of Example 1 were repeated, except that the 2,2'-methylenebis(4-methyl-6-tert-butylphenol) used in the preparation of the dispersion D was replaced by 4,4'-dihydroxy-3,3',5,5'-tetrabromodiphenylsulfone, to thereby obtain a comparative heat-sensitive recording material.

Comparative Example 9

The procedures of Example 1 were repeated, except that the dispersion D was not used, to thereby obtain a comparative heat-sensitive recording material.

Comparative Example 10

The procedures of Example 6 were repeated, except that the dispersion D was not used, to thereby obtain a comparative heat-sensitive recording material.

Comparative Example 11

The procedures of Example 7 were repeated, except that the dispersion D was not used, to thereby obtain a comparative heat-sensitive recording material.

Comparative Example 12

The procedures of Example 8 were repeated, except that the dispersion D was not used, to thereby obtain a comparative heat-sensitive recording material.

Comparative Example 13

The procedures of Example 9 were repeated, except that the dispersion D was not used, to thereby obtain a comparative heat-sensitive recording material.

Comparative Example 14

The procedures of Example 10 were repeated, except that the dispersion D was not used, to thereby obtain a comparative heat-sensitive recording material.

Comparative Example 15

The procedures of Example 12 were repeated, except 'that the dispersion D was not used, to thereby obtain a comparative heat-sensitive recording material.

Comparative Example 16

The procedures of Example 13 were repeated, except that the dispersion D was not used, to thereby obtain a comparative heat-sensitive recording material.

Comparative Example 17

The procedures of Example 14 were repeated, except that the dispersion D was not used, to thereby obtain a comparative heat-sensitive recording material.

Comparative Example 18

The procedures of Example 15 were repeated, except that the dispersion D was not used, to thereby obtain a comparative heat-sensitive recording material.

Comparative Example 19

The procedures of Example 16 were repeated, except that the dispersion D was not used, to thereby obtain a comparative heat-sensitive recording material.

EVALUATION

Each of thirty five kinds of the heat-sensitive recording materials obtained in Examples 1 to 16 and Comparative Examples 1 to 19 were evaluated respectively in the following manner with respect to (1) coloring ability, (2) light resistance, and (3) background discoloration.

(1) Coloring Ability

The heat-sensitive recording material was set to a heat-sensitive printer of PC-100A type (produced by Texas Instrument Company), wherein an image was recorded on the heat-sensitive recording material. The optical density of the record image was examined by the use of a reflection densitometer of RD-914 type (produced by Macbeth Company).

In this case, the optical density of the record image was examined by a visual mode. As for the result, the larger the resultant value indicates a higher record density as recognized by eyes.

In addition, the reflectance of the record image was examined by the use of a spectrophotometer of 900 nm (produced by Nippon Bunkosha Kabushiki Kaisha). As for result, the smaller the resultant value indicates a higher record density in the near infrared region.

(2) Light Resistance

The heat-sensitive recording material having the record image obtained in the above (1) was maintained under irradiation of fluorescent light for 30 days. The resultant was examined by the use of a reflection densitometer of RD-914 type (produced by Macbeth Company) and a spectrophotometer of 900 nm (produced by Nippon Bunkosha Kabushiki Kaisha) respectively in the same manner as in the case (1).

(3) Background Discoloration

The heat-sensitive recording material which was maintained under irradiation of fluorescent light for 30 days in the above (2) was observed by eyes with respect to the background discoloration.

(4) Deterioration of Background Brightness (i) The heat-sensitive recording material was set to a commercially available Hunter reflectometer with a blue filter to observe the initial background brightness thereof.

(ii) Then, the heat-sensitive recording material was maintained under irradiation of fluorescent light for 30 days and the resultant was set to said Hunter reflectometer to observe the background brightness thereof.

The result obtained in the observation (i) was compared with the result obtained in the observation (ii) to thereby examine the degree of deterioration in background brightness when the heat-sensitive recording material was maintained under irradiation of fluorescent light.

The evaluated results obtained in the above evaluations (1) to (4) were collectively shown in the following Table 1.

In Table 1, the evaluated result with respect to the background discoloration was shown with the following criteria.

⊖:any distinguishable background discoloration was not observed.

Δ:distinguishable background discoloration was observed.

X:marked background discoloration was observed.

From the results shown in Table 1, it is clearly understood that any of the heat-sensitive recording materials according to the present invention obtained in Examples 1 to 16 provides an excellent record image which is stably maintained in the original state without deteriorated and without causing discoloration in the background even upon storing under irradiation of light over a long period of time.

TABLE 1

| | coloring ability | | light resistance | | | Hunter value | |
|---|---|---|---|---|---|---|---|
| | Macbeth | spectrophotometer (%) | Macbeth | spectrophotometer (%) | background discoloration | before exposure to fluorescent light | after exposure to fluorescent light |
| Example 1 | 1.40 | 15.4 | 1.38 | 19.5 | ○ | 78.0 | 77.4 |
| Example 2 | 1.40 | 15.5 | 1.38 | 18.6 | ○ | 78.5 | 78.0 |
| Example 3 | 1.38 | 14.6 | 1.33 | 16.6 | ○ | 79.0 | 78.6 |
| Example 4 | 1.42 | 12.6 | 1.40 | 18.4 | ○ | 78.2 | 77.0 |
| Example 5 | 1.43 | 13.3 | 1.40 | 17.7 | ○ | 77.4 | 75.2 |
| Example 6 | 1.40 | 11.9 | 1.32 | 20.7 | ○ | 77.6 | 75.5 |
| Example 7 | 1.39 | 11.6 | 1.33 | 13.8 | ○ | 70.3 | 68.8 |
| Example 8 | 1.45 | 10.1 | 1.42 | 12.9 | ○ | 77.5 | 75.9 |
| Example 9 | 1.36 | 15.8 | 1.35 | 19.9 | ○ | 76.7 | 75.7 |
| Example 10 | 1.43 | 12.8 | 1.40 | 18.7 | ○ | 78.5 | 77.4 |
| Example 11 | 1.40 | 14.9 | 1.37 | 18.3 | ○ | 77.8 | 77.3 |
| Example 12 | 1.35 | 16.9 | 1.33 | 21.2 | ○ | 76.9 | 76.0 |
| Example 13 | 1.44 | 11.7 | 1.30 | 17.1 | ○ | 79.2 | 77.2 |
| Example 14 | 1.34 | 10.5 | 1.33 | 22.6 | ○ | 81.3 | 81.0 |
| Example 15 | 1.40 | 15.6 | 1.37 | 18.5 | ○ | 78.0 | 77.3 |
| Example 16 | 1.45 | 12.7 | 1.35 | 17.0 | ○ | 82.4 | 81.4 |
| Comparative Example 1 | 1.35 | 19.7 | 0.87 | 56.0 | ○ | 78.0 | 77.6 |
| Comparative Example 2 | 1.40 | 15.7 | 1.36 | 19.5 | X | 78.0 | 62.8 |
| Comparative Example 3 | 1.41 | 14.4 | 1.37 | 18.4 | X | 77.5 | 62.2 |
| Comparative Example 4 | 1.38 | 15.9 | 1.33 | 22.1 | X | 78.0 | 62.8 |
| Comparative Example 5 | 1.39 | 15.7 | 1.30 | 23.7 | Δ | 77.0 | 69.3 |
| Comparative Example 6 | 1.34 | 18.9 | 1.26 | 28.9 | X | 76.0 | 60.2 |
| Comparative Example 7 | 1.37 | 14.8 | 1.36 | 17.2 | X | 78.0 | 63.4 |
| Comparative Example 8 | 1.37 | 19.6 | 1.24 | 20.0 | X | 75.4 | 61.6 |
| Comparative Example 9 | 1.40 | 15.4 | 1.38 | 19.5 | X | 77.9 | 62.8 |
| Comparative Example 10 | 1.40 | 11.9 | 1.32 | 20.7 | X | 77.6 | 57.4 |
| Comparative Example 11 | 1.39 | 11.6 | 1.33 | 13.8 | X | 70.3 | 55.7 |
| Comparative Example 12 | 1.45 | 10.1 | 1.40 | 12.9 | X | 77.5 | 61.1 |
| Comparative Example 13 | 1.36 | 15.9 | 1.35 | 19.9 | X | 76.7 | 62.0 |
| Comparative Example 14 | 1.43 | 12.8 | 1.39 | 18.7 | X | 78.5 | 65.5 |
| Comparative Example 15 | 1.35 | 16.9 | 1.33 | 21.2 | X | 76.9 | 62.2 |
| Comparative Example 16 | 1.44 | 11.7 | 1.30 | 17.1 | X | 79.2 | 66.1 |
| Comparative Example 17 | 1.34 | 10.5 | 1.33 | 22.6 | X | 81.3 | 70.9 |
| Comparative Example 18 | 1.40 | 15.6 | 1.37 | 18.6 | X | 78.0 | 62.5 |
| Comparative Example 19 | 1.45 | 12.7 | 1.35 | 17.0 | X | 82.4 | 57.9 |

(evaluation criteria of background discoloration)
○: any distinguishable background discoloration was not observed
Δ: distinguishable background discoloration was observed
X: marked background discoloration was observed

What we claim is:

1. A heat-sensitive recording material comprising a substrate and a heat-sensitive recording layer disposed on said substrate, said heat-sensitive recording layer containing a colorless or light-colored basic dye and a color developer capable of causing color development upon contact with said basic dye by application of heat, wherein said heat-sensitive recording layer contains (i) an antioxidant, (ii) an aromatic secondary amine compound, and (iii) as said colorless or light-colored basic dye, a basic dye which absorbs electromagnetic radiation having a wavelength in the near infrared region with respect to an image provided, wherein said antioxidant comprises at least one member selected from the group consisting of the compounds represented by the following structural formula (I)

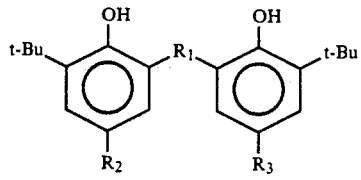

(I)

wherein $R_1$ is a substituted or unsubstituted, saturated or unsaturated alkylene group, or a substituted or unsubstituted cycloalkylene group; $R_2$ and $R_3$ may be identical or different and are each hydrogen atom, halogen atom, a substituted or unsubstituted, saturated or unsaturated alkyl group, or a substituted or unsubstituted, saturated or unsaturated alkoxy group, and the compounds represented by the following structural formula (II)

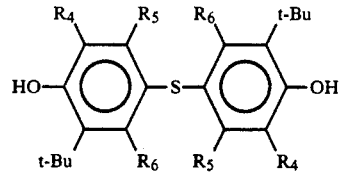

(II)

wherein $R_4$, $R_5$ and $R_6$ are each hydrogen atom, halogen atom, a substituted or unsubstituted, saturated or unsaturated alkyl group, or a substituted or unsubstituted, saturated or unsaturated alkoxy group.

2. A heat-sensitive recording material according to claim 1, wherein the compounds represented by the structural formula (I) are 2,2'-methylenebis(4-methyl-6-tert-butylphenol), 2,2'-methylenebis(4-ethyl-6-tert-butylphenol), 2,2'-methylenebis(4-ethyl-6-tert-butylphenol) and 2,2'-ethylidenebis(4,6-di-tert-butylphenol); and the compounds represented by the structural formula (II) are 4,4'-thiobis(2-methyl-6-tert-butylphenol) and 4,4'-thiobis(3-methyl-6-tert-butylphenol).

3. A heat-sensitive recording material according to claim 1, wherein the aromatic secondary amine compound comprises at least one member selected from the group consisting of phenyl-1-naphthylamine, 4,4'-dioctyldiphenylamine, 4,4'-bis(α,αdimethylbenzyl)diphenylamine, p-(p-toluenesulfonylamido)diphenylamine, N,N'-di-2-naphthyl-p-phenylenediamine, N,N'-diphenyl-p-phenylenediamine, N-phenyl-N'-isopropyl-p-phenylenediamine, N-phenyl-N'-(1,3-dimethylbutyl)-p-phenylenediamine, and N-phenyl-N'-(3-methacryloyloxy-2-hydroxypropyl)-p-phenylenediamine.

4. A heat-sensitive recording material according to claim 1, wherein the aromatic secondary amine compound comprises at least one member selected from the group consisting of N,N'-di-2-naphthyl-p-phenylenediamine, and 4,4'-bis($\alpha$,$\alpha$-dimethylbenzyl)diphenylamine.

5. A heat-sensitive recording material according to claim 1, wherein the aromatic secondary amine compound is N,N'-di-2-naphthyl-p-phenylenediamine.

6. A heat-sensitive recording material according to claim 1, wherein the heat-sensitive recording layer further contains a colorless or light-colored basic dye which absorbs eletromagnetic radiation having a wavelength in the visible region with respect to an image provided.

* * * * *